US009368336B2

(12) United States Patent
Xu et al.

(10) Patent No.: US 9,368,336 B2
(45) Date of Patent: Jun. 14, 2016

(54) ION TRAP-BASED APPARATUS AND METHOD FOR ANALYZING AND DETECTING BIPOLAR IONS

(71) Applicant: Beijing Institute of Technology, Beijing (CN)

(72) Inventors: Wei Xu, Beijing (CN); Muyi He, Beijing (CN); You Jiang, Beijing (CN); Zejian Huang, Beijing (CN); Xingchuang Xiong, Beijing (CN); Xiang Fang, Beijing (CN)

(73) Assignee: Beijing Institute of Technology, Beijing (CN)

( * ) Notice: Subject to any disclaimer, the term of this patent is extended or adjusted under 35 U.S.C. 154(b) by 0 days.

(21) Appl. No.: 14/433,600

(22) PCT Filed: Jan. 31, 2013

(86) PCT No.: PCT/CN2013/000102
§ 371 (c)(1),
(2) Date: Apr. 3, 2015

(87) PCT Pub. No.: WO2014/117293
PCT Pub. Date: Aug. 7, 2014

(65) Prior Publication Data
US 2015/0255265 A1 Sep. 10, 2015

(51) Int. Cl.
*H01J 49/00* (2006.01)
*H01J 49/42* (2006.01)

(52) U.S. Cl.
CPC ..... *H01J 49/4255* (2013.01); *H01J 49/0031* (2013.01); *H01J 49/0072* (2013.01); *H01J 49/0095* (2013.01); *H01J 49/424* (2013.01)

(58) Field of Classification Search
USPC ..... 250/281, 282, 283, 285, 288
See application file for complete search history.

(56) References Cited

U.S. PATENT DOCUMENTS

| | | | | |
|---|---|---|---|---|
| 6,392,225 | B1 | 5/2002 | Schwartz et al. | |
| 2008/0203288 | A1 * | 8/2008 | Makarov ..... | H01J 49/004 250/282 |

FOREIGN PATENT DOCUMENTS

| | | | |
|---|---|---|---|
| CN | 101777483 (A) | | 7/2010 |
| CN | 101802966 | A | 8/2010 |
| CN | 101802966 (A) | | 8/2010 |
| CN | 102103973 (A) | | 6/2011 |
| CN | 101777483 | B | 3/2012 |
| CN | 102103973 | B | 11/2012 |
| WO | WO 2011/086430 | A1 | 7/2011 |

* cited by examiner

*Primary Examiner* — Nicole Ippolito
*Assistant Examiner* — Hanway Chang
(74) *Attorney, Agent, or Firm* — Muncy, Geissler, Olds & Lowe, P.C.

(57) ABSTRACT

An ion trap-based device and method for analyzing and detecting bipolar ions is provided. The device includes multiple electrodes of an ion trap; a radio frequency voltage source configured to form a radio frequency electric field; a direct current voltage source configured to form a bias electric field, positive and negative ions in the ion trap being separated by the bias electric field; a first and second detectors, configured to detect the positive and negative ions, respectively. A bipole and quadrupole field direct current voltage detection modes may be employed. A single positive ion or negative ion operation mode in a conventional biological mass spectrometry method is improved, so that the positive and negative ion modes are performed simultaneously; without any resolution loss, the analysis speed is increased, the sample consumption is reduced, and the accuracy of quantitative analysis of the samples is improved.

18 Claims, 5 Drawing Sheets

ION TRAP-BASED APPARATUS AND METHOD FOR ANALYZING AND DETECTING BIPOLAR IONS

TECHNICAL FIELD

The present disclosure relates to a mass spectrometer, and more particularly, to an ion trap-based device and method for analyzing and detecting bipolar ions.

BACKGROUND

Mass spectrometry refers to an analysis method that separates and detects compounds by different mass-to-charge ratios (m/z) to implement component and structure identification. The mass spectrometry technique has become increasingly prominent in the field of bioanalysis due to its high specificity and sensitivity. Bio-mass spectrometry (Bio-MS) is a mass spectrometry technique applied to analyze biomolecules, which is widely applied in protein and polypeptide researches such as relative molecular mass determination of protein, peptide mapping determination, peptide sequence determination technique, assignment of sulfhydryl group and disulfide bond, posttranslational modification of protein, quantitative proteome analysis, protein-protein interaction research, and the like. Moreover, the bio-mass spectrometry is also applied to such fields as polysaccharose structure determination, oligonucleotide and nucleic acid analysis, microorganism identification, medicament research and development and the like.

With the development of the mass spectrometry technique, its related manners of ionization change rapidly. A bipolar ionization method is developed by many researchers on the basis of the predecessors, which can ionize samples to form positive and negative ions. Huang [1, 2] et al make improvement on the basis of a nano-ESI source, and obtain bipolar ions of the samples through a manner of pulsed high voltage induction. Nishant Chetwani [3, 4] et al also conduct similar studies, and develop a novel high frequency alternating current field ESI source, which can obtain bipolar ions on the basis of different modes. Usually, two different modes based on positive and negative ion are employed to detect the bipolar ions separately. On the other hand, there are also researchers devoting to developing a method of simultaneously detecting bipolar ions: Chen. [5] et al develop a bipolar Taylor cone-based method for synchronously detecting bipolar ions; and Tsai [6] et al develop a bipolar time of flight detector (TOF) based method for detecting bipolar ions and apply relevant patents. Generally, in prior methods, the positive and negative ions are separately detected through using two sets of mass spectrometry/mass analyzers; or through twice mass spectrometry analysis by using one set of mass spectrometry/mass analyzer, where one analysis is for analyzing the positive ions and another analysis is for analyzing the negative ions. In current mode of processing, positive ion mode detection and negative ion mode detection are separately performed by employing different operation parameters, and subsequent detection such as tandem mass spectrometry (also referred to as "MS/MS" hereinbelow) and the like is continuously performed after one polar ion is excluded, which increases the sample consumption and reduces the detection efficiency.

SUMMARY

A technical problem to be solved by the present disclosure is to overcome the defects of the related art and provide an ion trap-based device and method for separating and detecting bipolar ions, which can monitor and analyze positive and negative parent ions as well as product ions simultaneously during a gas phase ionic reaction process. The positive and negative ions are detected simultaneously during one mass spectrometry; that is, the positive and negative ions in biological samples are separated and detected at a same time. The sample consumption is reduced, the analysis speed is increased, and the accuracy of quantitative analysis of the samples is improved.

According to a first aspect of the present disclosure, there is provided an ion trap-based device for analyzing and detecting bipolar ions, including: an ion trap, the ion trap including multiple electrodes; a radio frequency voltage source (RF) for applying a radio frequency voltage (V) on the electrodes of the ion trap to form a radio frequency electric field; a direct current voltage source for applying a direct current voltage (U) on different electrodes of the ion trap to form a bias electric field, positive ions and negative ions in the ion trap being separated under the effect of the bias electric field; a first detector for detecting positive ions disposed outside the electrodes of the ion trap for emitting the positive ion; and a second detector for detecting negative ions disposed outside the electrodes of the ion trap for emitting the negative ion.

Alternatively, the ion trap-based device for analyzing and detecting bipolar ions may employ a bipole field direct current voltage detection mode. The different electrodes of the ion trap are two different electrodes on the same axis of the ion trap, and the applying the direct current voltage on the different electrodes of the ion trap to form the bias electric field is to respectively apply a positive direct current voltage and a negative direct current voltage having equal or unequal value but opposite polarities on the two different electrodes on the same axis of the ion trap to form the bias electric field, the positive ions and the negative ions in the ion trap being separated under the effect of the bias electric field and respectively approaching to the electrodes having polarity opposite to themselves, the positive ions approaching to the electrode on which the negative direct current voltage is applied, and the negative ions approaching to the electrode on which the positive direct current voltage is applied. The device for analyzing and detecting bipolar ions further includes an excitation alternating current voltage source. The excitation alternating current voltage source applies an excitation alternating current voltage (AC) on the two different electrodes on the same axis to form an excitation alternating current electric field after the positive ions and the negative ions are separated under the effect of the bias electric field, the separated positive ions and negative ions being respectively emitted from the different electrodes of the ion trap under the effect of the excitation alternating current electric field and leaving the ion trap, and there are openings, from which the ions are emitted, disposed on the two different on the same axis of the ion trap; the positive ions being emitted from an electrode tip on which the negative direct current voltage is applied and being detected by the first detector, and the negative ions being emitted from an electrode tip on which the positive direct current voltage is applied and being detected by the second detector.

The initial value of the positive direct current voltage is 5 V, the initial value of the negative direct current voltage is −5 V, and the scanning speed of the positive direct current voltage and the negative direct current voltage is 1,000 V/s; the amplitude of the excitation alternating current voltage is 20 V, and the frequency of the excitation alternating current voltage is 300,000 Hz; the initial voltage amplitude of the radio frequency voltage is 380 V, the frequency of the radio frequency voltage is 1,000,000 Hz, and the scanning speed of the radio frequency voltage is 1,000 V/s.

Alternatively, the ion trap-based device for analyzing and detecting bipolar ions may employ a quadrupole field direct current voltage detection mode. The different electrodes of the ion trap include two electrodes on the y axis of the ion trap and two electrodes on the x axis of the ion trap, and the applying the direct current voltage on the different electrodes of the ion trap to form the bias electric field is to apply negative direct current voltages having an equal value on the two electrodes on the y axis of the ion trap and apply positive direct current voltages having an equal value on the two electrodes on the x axis of the ion trap, the bias electric field being formed by the negative direct current voltages and the positive direct current voltages, the amplitudes of the negative direct current voltages and the positive direct current voltages being equal or unequal, and the positive ions and the negative ions in the ion trap being separated under the effect of the bias electric field, so that the positive ions are compressed on the x axis and the negative ions are compressed on the y axis; a direct current voltage scanning mode and a radio frequency voltage scanning mode being employed to increase the amplitude of the direct current voltage and increase the amplitude of radio frequency voltage, the compression degree of the positive ions on the x axis being increased, and the compression degree of the negative ions on the y axis being increased, the positive ions tending to be emitted from the y axis and the negative ions tending to be emitted from the x axis, when the ions leave an xy stable region, the motion amplitudes of the ions on one direction being continuously increased so that the ions are ejected out of the ion trap, the positive ions being ejected from the y axis and the negative ions being ejected from the x axis.

Alternatively, with respect to the ion trap-based device for analyzing and detecting bipolar ions employing the quadrupole field direct current voltage detection mode, the amplitudes of the negative direct current voltage and the positive direct current voltage are equal to each other, the amplitudes of the negative direct current voltage and the positive direct current voltage are U, and the amplitude of the radio frequency voltage is V; when U and V are certain, the positive ions and the negative ions are respectively arranged along a positive ion operating line and a negative ion operating line according to different mass-to-charge ratios thereof; the voltage values of U and V are increased while keeping the UN' unchanged, the positive ions travel along the positive ion operating line and the negative ions travel along the negative ion operating line; when the ions leave the xy stable region, the motion amplitudes of the ions on one direction are continuously increased so that the ions are ejected out of the ion trap.

Alternatively, with respect to the ion trap-based device for analyzing and detecting bipolar ions employing the quadrupole field direct current voltage detection mode, an excitation alternating current voltage source may further be included. The excitation alternating current voltage source applies an excitation alternating current voltage on the two different electrodes on the x axis and two different electrodes on the y axis to form an excitation alternating current electric field to form an excitation alternating current electric field after the positive ions and the negative ions are separated under the effect of the bias electric field, after the excitation alternating current electric field is formed, when the positive ions travel along the positive ion operating line and reach a positive ion AC excitation line, the positive ions being resonated and ejected out of the ion trap; when the negative ions travel along the negative ion operating line and reach a negative ion AC excitation line, the negative ions being resonated and ejected out of the ion trap, wherein AC represents the excitation alternating current voltage.

The initial voltage amplitude of the radio frequency voltage is 380 V, the frequency of the radio frequency voltage is 1,000,000 Hz, and the scanning speed of the radio frequency voltage is 1,000 V/s; the UN value is 0.075; the amplitude of the excitation alternating current voltage is 20 V, and the frequency of the excitation alternating current voltage is 310,000 Hz.

According to a second aspect of the present disclosure, there is provided an ion trap-based method for analyzing and detecting bipolar ions, including: applying a radio frequency voltage on electrodes of an ion trap to form a radio frequency electric field; and applying a direct current voltage on different electrodes of the ion trap to form a bias electric field, positive ions and negative ions in the ion trap being separated under the effect of the bias electric field; the positive ions being emitted from an electrode tip on which a negative direct current voltage is applied and detected, and the negative ions being emitted from an electrode tip on which a positive direct current voltage is applied and detected.

Alternatively, the ion trap-based method for analyzing and detecting bipolar ions may employ a bipole field direct current voltage detection mode. The different electrodes of the ion trap are two different electrodes of the ion trap on the same axis, and the applying the direct current voltage on the different electrodes of the ion trap to form the bias electric field includes respectively applying a positive direct current voltage and a negative direct current voltage having equal or unequal value but opposite polarities on the two different electrodes of the ion trap on the same axis to form the bias electric field, the positive ions and the negative ions in the ion trap being separated under the effect of the bias electric field and respectively approaching to the electrodes having opposite polarity, the positive ions approaching to the electrode on which the negative direct current voltage is applied, and the negative ions approaching to the electrode on which the positive direct current voltage is applied; an excitation alternating current voltage being applied on the two different electrodes on the same axis to form an excitation alternating current electric field, the separated positive ions and negative ions being respectively emitted from the different electrodes of the ion trap under the effect of the excitation alternating current electric field and leaving the ion trap, there are openings, from which the ions are emitted, disposed on the two different electrodes on the same axis of the ion trap; and the positive ions being emitted from an electrode tip on which the negative direct current voltage is applied and being detected, and the negative ions being emitted from an electrode tip on which the positive direct current voltage is applied and being detected.

The initial value of the positive direct current voltage is 5 V, the initial value of the negative direct current voltage is −5 V, and the scanning speed of the positive direct current voltage and the negative direct current voltage is 1,000 V/s; the amplitude of the excitation alternating current voltage is 20 V, and the frequency of the excitation alternating current voltage is 300,000 Hz; the initial voltage amplitude of the radio frequency voltage is 380 V, the frequency of the radio frequency voltage is 1,000,000 Hz, and the scanning speed of the radio frequency voltage is 1,000 V/s.

Alternatively, the ion trap-based method for analyzing and detecting bipolar ions may employ a quadrupole field direct current voltage detection mode. The different electrodes of the ion trap include two electrodes on the y axis of the ion trap and two electrodes on the x axis of the ion trap, and the applying the direct current voltage on the different electrodes of the ion trap to form the bias electric field including applying negative direct current voltages having an equal value on the two electrodes on the y axis of the ion trap and applying positive direct current voltages having an equal value on the two electrodes on the x axis of the ion trap, the bias electric field being formed by the negative direct current voltages and the positive direct current voltages; the amplitudes of the negative direct current voltages and the positive direct current voltages being equal or unequal to each other, and the positive ions and the negative ions in the ion trap being separated under the effect of the bias electric field, so that the positive ions are compressed on the x axis and the negative ions are compressed on the y axis; a direct current voltage scanning mode and a radio frequency scanning system mode being employed to increase the amplitude of the direct current voltages and increase the amplitude of radio frequency voltages, the compression degree of the positive ions on the x axis being increased, and the compression degree of the negative ions on the y axis being increased, the positive ions tending to be emitted from the y axis and the negative ions tending to be emitted from the x axis, when the ions leave an xy stable region, the motion amplitudes of the ions on one direction being continuously increased so that the ions are ejected out of the ion trap, the positive ions being ejected from the y axis and the negative ions being ejected from the x axis.

Alternatively, with respect to the ion trap-based method for analyzing and detecting bipolar ions employing the quadrupole field direct current voltage detection mode, the amplitudes of the negative direct current voltage and the positive direct current voltage may be equal to each other, the amplitudes of the negative direct current voltage and the positive direct current voltage are U, and the amplitude of the radio frequency voltage is V; when U and V are certain, the positive ions and the negative ions are respectively arranged on a positive ion operating line and a negative ion operating line according to different mass-to-charge ratios thereof; the voltage values of U and V are increased while keeping the UN unchanged, the positive ions travel along the positive ion operating line and the negative ions travel along the negative ion operating line; when the ions leave the xy stable region, the motion amplitudes of the ions on one direction are continuously increased so that the ions are ejected out of the ion trap.

Alternatively, with respect to the ion trap-based method for analyzing and detecting bipolar ions employing the quadrupole field direct current voltage detection mode, an excitation alternating current voltage is applied on two different electrodes on the x axis and two different electrodes on the y axis to form an excitation alternating current electric field, after the excitation alternating current electric field is formed, when the positive ions travel along the positive ion operating line and reach a positive ion AC excitation line, the positive ions being resonated and ejected out of the ion trap; when the negative ions travel along the negative ion operating line and reach a negative ion AC excitation line, the negative ions being resonated and ejected out of the ion trap, wherein AC represents the excitation alternating current voltage.

The initial voltage amplitude of the radio frequency voltage is 380 V, the frequency of the radio frequency voltage is 1,000,000 Hz, and the scanning speed of the radio frequency voltage is 1,000 V/s; the UN value is 0.075; the amplitude of the excitation alternating current voltage is 20 V, and the frequency of h excitation alternating current voltage is 310,000 Hz.

According to a third aspect of the present disclosure, there is provided a multi-stage tandem mass spectrometry (referred to as "MS(n)") method for bipolar ions, including:

firstly, applying an initial radio frequency voltage on electrodes of an ion trap to form a radio frequency electric field; and applying a direct current voltage on different electrodes of the ion trap to form a bias electric field, the different electrodes of the ion trap including two electrodes on the y axis of the ion trap and two electrodes on the x axis of the ion trap, and the applying the direct current voltage on the different electrodes of the ion trap to form the bias electric field including applying negative direct current voltages having an equal value on the two electrodes on the y axis of the ion trap and apply positive direct current voltages having an equal value on the two electrodes on the x axis of the ion trap, the bias electric field being formed by the negative direct current voltages and the positive direct current voltages; the amplitudes of the negative direct current voltages and the positive direct current voltages being equal or unequal to each other, and the positive ions and the negative ions in the ion trap being separated under the effect of the bias electric field, so that the positive ions are compressed on the x axis and the negative ions are compressed on the y axis;

afterwards, applying a Stored Waveform Inverse Fourier Transform (also referred to as "SWIFT" hereinbelow) excitation alternating current signal on the electrode on the x axis of the ion trap, so that the selected ion is in a stable region and other ions are excited and ejected out of the ion trap;

next, applying a SWIFT excitation alternating current signal on the electrode on the y axis of the ion trap and further determining the selected ion from the ions stably stored in the ion trap, so that the selected ion is in the stable region and other ions are excited and ejected out of the ion trap; and then, employing any ion trap-based method for analyzing and detecting bipolar ions mentioned above to analyze and detect bipolar ions in the selected ions that are stored in the ion trap.

According to a fourth aspect of the present disclosure, there is provided a MS(n) method for bipolar ions, including:

firstly applying an initial radio frequency voltage on electrodes of an ion trap to form a radio frequency electric field; and applying a direct current voltage on different electrodes of the ion trap to form a bias electric field, the different electrodes of the ion trap including two electrodes on the y axis of the ion trap and two electrodes on the x axis of the ion trap, and the applying the direct current voltage on the different electrodes of the ion trap to form the bias electric field including applying negative direct current voltages having an equal value on the two electrodes on the y axis of the ion trap and apply positive direct current voltages having an equal value on the two electrodes on the x axis of the ion trap, the bias electric field being formed by the negative direct current voltages and the positive direct current voltages; the amplitudes of the negative direct current voltages and the positive direct current voltages being equal or unequal to each other, and the positive ions and the negative ions in the ion trap being separated under the effect of the bias electric field, so that the positive ions are compressed on the x axis and the negative ions are compressed on the y axis;

afterwards, applying a SWIFT excitation alternating current signal on the electrode on the x axis of the ion trap and applying a SWIFT excitation alternating current signal on the electrode on the y axis of the ion trap, so that the selected ion is in a stable region and other ions are excited and ejected out of the ion trap; and then, employing any ion trap-based method for analyzing and detecting bipolar ions mentioned above to analyze and detect bipolar ions in the selected ions that are stored in the ion trap.

According to a fifth aspect of the present disclosure, there is provided a MS(n) device for bipolar ions, including:

a radio frequency voltage source for applying an initial radio frequency voltage on electrodes of an ion trap to form a radio frequency electric field;

a direct current voltage source for applying a direct current voltage on different electrodes of the ion trap to form a bias electric field, the different electrodes of the ion trap including two electrodes on the y axis of the ion trap and two electrodes on the x axis of the ion trap, and the applying the direct current voltage on the different electrodes of the ion trap to form the bias electric field including applying negative direct current voltages having an equal value on the two electrodes on the y axis of the ion trap and applying positive direct current voltages having an equal value on the two electrodes on the x axis of the ion trap, the bias electric field being formed by the negative direct current voltages and the positive direct current voltages; the amplitudes of the negative direct current voltages and the positive direct current voltages being equal or unequal to each other, and the positive ions and the negative ions in the ion trap being separated under the effect of the bias electric field, so that the positive ions are compressed on the x axis and the negative ions are compressed on the y axis; and an excitation signal source for firstly applying a SWIFT excitation alternating current signal on the electrode on the x axis of the ion trap after the positive ions and the negative ions are separated under the effect of the bias electric field, so that the selected ion is in a stable region and other ions are excited and ejected out of the ion trap; and then applying a SWIFT excitation alternating current signal on the electrode on the y axis of the ion trap and further determining the selected ion from the ions stably stored in the ion trap, so that the selected ion is in the stable region and other ions are excited and ejected out of the ion trap; and any ion trap-based device for analyzing and detecting bipolar ions mentioned above, the ion trap-based device for analyzing and detecting bipolar ions is used for analyzing and detecting bipolar ions in the selected ions that are stored in the ion trap.

According to a sixth aspect of the present disclosure, there is provided a MS(n) device for bipolar ions, including:

a radio frequency voltage source for applying an initial radio frequency voltage on electrodes of an ion trap to form a radio frequency electric field;

a direct current voltage source for applying a direct current voltage on different electrodes of the ion trap to form a bias electric field, the different electrodes of the ion trap including two electrodes on the y axis of the ion trap and two electrodes on the x axis of the ion trap, the applying the direct current voltage on the different electrodes of the ion trap to form the bias electric field including applying negative direct current voltages having an equal value on the two electrodes on the y axis of the ion trap and applying positive direct current voltages having an equal value on the two electrodes on the x axis of the ion trap, the bias electric field being formed by the negative direct current voltages and the positive direct current voltages; the amplitudes of the negative direct current voltages and the positive direct current voltages being equal or unequal to each other, and the positive ions and the negative ions in the ion trap being separated under the effect of the bias electric field, so that the positive ions are compressed on the x axis and the negative ions are compressed on the y axis; and an excitation signal source for simultaneously applying a SWIFT excitation alternating current signal on the electrode on the x axis of the ion trap and applying a SWIFT excitation alternating current signal on the electrode on the y axis of the ion trap, so that the selected ion is in a stable region and other ions are excited and ejected out of the ion trap;

any ion trap-based device for analyzing and detecting bipolar ions mentioned above, the ion trap-based device for analyzing and detecting bipolar ions is used for analyzing and detecting bipolar ions in the selected ions that are stored in the ion trap.

Compared with the related art, the present disclosure has the following advantageous and beneficial effects.

The ion trap-based device and method for analyzing and detecting bipolar ions provided by the present disclosure enable separation and detection of the positive and negative ions in biological samples at one time, and can be applied to linear ion traps and three-dimensional ion traps. The present disclosure can be used for the simultaneous detection of the positive and negative ions during a gas phase ionic reaction process, which improves the quantity of information, and may also enable control of the ionic reaction process. The bipolar ion analysis mode employed enables the MS(n) of the complicated positive and negative ion reaction and the bipolar ions during the detection process. Compared with a conventional mass spectrogram, three-dimensional information of the polarity of the ions is added in the obtained bipolar mass spectrogram. Compared with the related art, the positive and negative ion modes are performed simultaneously so that speed of the mass spectrometry analysis may be improved by one time and the sample consumption may be reduce by 50%. The present disclosure reduces the sample consumption during a polarity selection process, and effectively improves the accuracy of quantitative analysis. In the application of protein detection, the bipolar mode can improve the coverage of peptide fragments having different polarities, so that the result of data base comparison may be more reliable.

BRIEF DESCRIPTION OF THE DRAWINGS

It should be noted that the accompanying drawings described hereinafter only schematically show some embodiments, but do not include all the probable embodiments.

DETAILED DESCRIPTION OF THE INVENTION

To further clarify the object, technical solution and advantages of the present invention, the technical solution according to the embodiments of the present invention will be described hereinafter with reference to the accompanying drawings. Apparently, the embodiments described are merely partial embodiments of the present invention, rather than all embodiments. The embodiments described are for illustration, but not intended to restrict the scope of the present invention. Other embodiments derived by those having ordinary skills in the art on the basis of the embodiments of the present disclosure without going through creative efforts shall fall within the protection scope of the present invention.

Figure 6A:
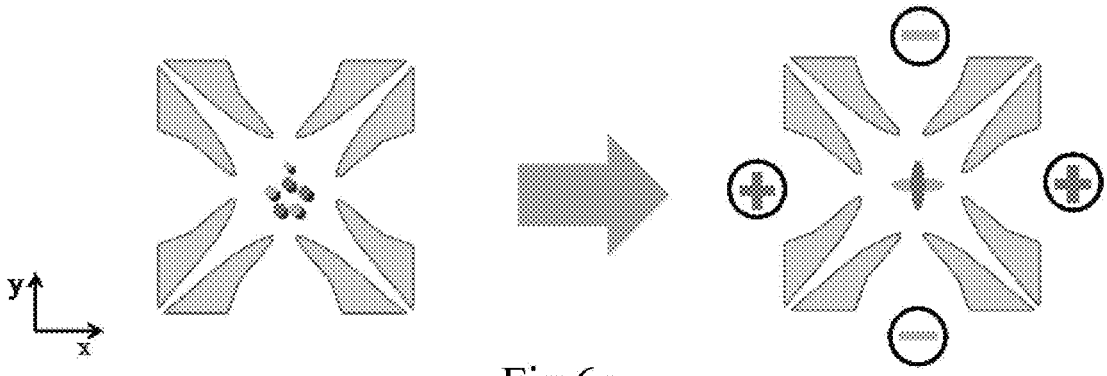
FIG. 6*a* and FIG. 6*b* illustrate schematic diagrams showing a quadrupole field direct current voltage detection mode according to exemplary embodiments of the present disclosure.

In order to present conveniently, the directions of the "x axis" and "y axis" mentioned herein are consistent with the "x axis" and "y axis" in FIG. 6*a*, and the definitions of "x" and "y" are identical to the definition in a rectangular coordinate system, but are not restrictive of the structure of the present disclosure.

Compared with other mass detectors, ion trap has the characteristics of small volume, high resolution, and the like, and is particularly suitable to tandem mass spectrometry (also referred to as "MS/MS" herein) and multi-stage tandem mass spectrometry (also referred to as "MS(n)" herein) detection of various samples. Due to the multiple advantages of the ion trap, the present disclosure designs an ion trap-based technical solution for analyzing and detecting bipolar ions, which can simultaneously detect positive and negative ions during one mass spectrometry, for example, the technical solution can be applied to linear ion traps and three-dimensional ion traps.

According to exemplary embodiments of the present disclosure, there is provided an ion trap-based device for analyzing and detecting bipolar ions, including: an ion trap, the ion trap including multiple electrodes; a radio frequency voltage source, configured to apply a radio frequency voltage on the electrodes of the ion trap to form a radio frequency electric field; a direct current voltage source, configured to apply a direct current voltage on different electrodes of the ion trap to form a bias electric field, positive ions and negative ions in the ion trap being separated under the effect of the bias electric field; a first detector, disposed outside the electrodes of the ion trap for emitting the positive ions and configured to detect the positive ions; and a second detector, disposed outside the electrodes of the ion trap for emitting the negative ions and configured to detect negative ions.

According to exemplary embodiments of the present disclosure, there is provided an ion trap-based method for analyzing and detecting bipolar ions, including: applying a radio frequency voltage on electrodes of an ion trap to form a radio frequency electric field; and applying a direct current voltage on different electrodes of the ion trap to form a bias electric field, positive ions and negative ions in the ion trap being separated under the effect of the bias electric field; the positive ions being emitted from an electrode tip on which a negative direct current voltage is applied and being detected, and the negative ions being emitted from an electrode tip on which a positive direct current voltage is applied and being detected.

As an alternative embodiment of the present disclosure, the ion trap-based method for analyzing and detecting bipolar ions according to the present disclosure may employ a bipole field direct current voltage detection mode or a quadrupole field direct current voltage detection mode, which will be described hereinafter with reference to the accompanying drawings.

(1) Bipole Field Direct Current Voltage Detection Mode

Figures 1A, 1B:
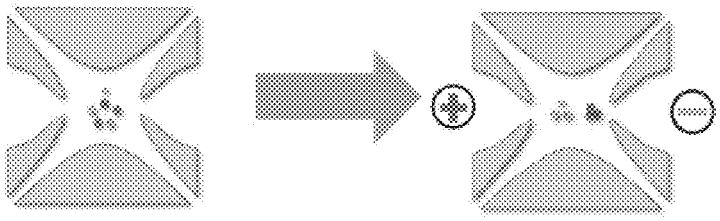
FIG. 1*a* illustrates a schematic diagram showing homogeneous distribution of bipolar ions in an ion trap without effect of a bias electric field.
FIG. 1*b* illustrates a schematic diagram showing separation of the bipolar ions under the effect of the bias electric field.

After the positive and negative ions are generated, a bipolar ion transport manner is employed to import the ions into an ion trap, and bipolar ions are homogeneously distributed in the ion trap under the effect of a radio frequency electric field, as shown in FIG. 1*a*. For example, a radio frequency voltage may be applied to electrodes of the ion trap by a radio frequency voltage source RF to form a radio frequency electric field. The bipolar ions include positive ions and negative ions. In FIG. 1*a*, no direct current voltage is applied on the electrodes of the ion trap. Direct current voltages DC having equal or unequal value but opposite polarities are respectively applied on two different electrodes on a same axial direction of the ion trap to form a bias electric field, the positive ions and the negative ions are separated under the effect of the bias electric field and respectively approach to the electrodes having polarities opposite to themselves, the positive ions approach to the electrode on which a negative direct current voltage is applied, and the negative ions approach to the electrode on which a positive direct current voltage is applied, as shown in FIG. 1*b*.

Figures 2A, 2B:
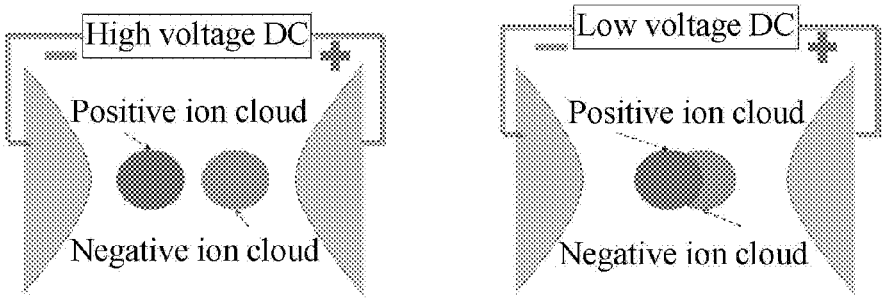
FIG. 2*a* and FIG. 2*b* show influences of a direct current voltage magnitude of a bipole field direct current voltage detection mode on the separation of the bipolar ions.

FIG. 2*a* and FIG. 2*b* show influences of a direct current voltage DC under a bipole field direct current voltage detection mode on the distribution of the bipolar ions. As shown in FIG. 2*a* and FIG. 2*b*, with the increasing of the direct current voltage DC, the separation degree of the bipolar ions is gradually increased, and the distance to the electrode having opposite polarities is gradually decreased; therefore, probability of emission from the electrode is increased therewith.

Figure 3:
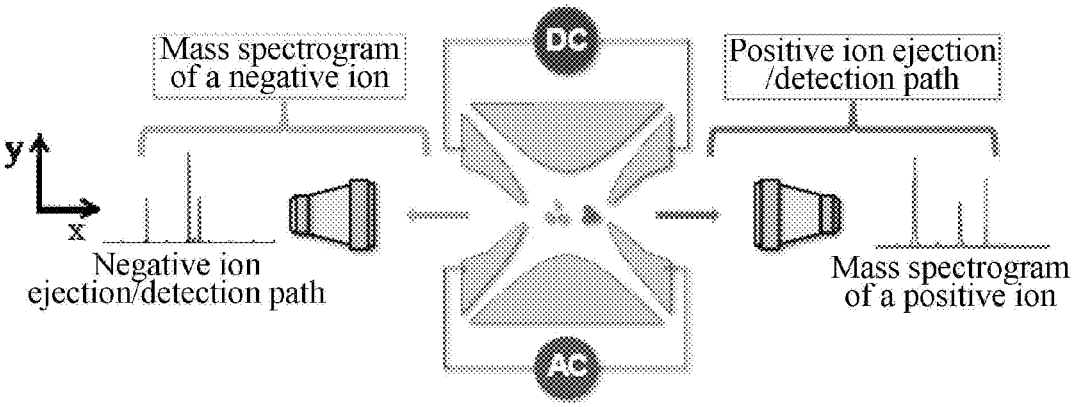
FIG. 3 illustrates a schematic diagram showing a bipole field direct current voltage detection mode according to an exemplary embodiment of the present disclosure.

FIG. 3 is a block diagram showing a bipole field direct current voltage detection mode according to exemplary embodiments of the present disclosure. As shown in FIG. 3, direct current voltages DC having equal or unequal value but opposite polarities are respectively applied on two different electrodes on a same axial direction of an ion trap to form a bias electric field. For example, the direct current voltages DC having equal or unequal value but opposite polarities are applied on different electrodes on the same direction of x axis of the ion trap to form the bias electric field. Positive ions and negative ions are separated under the effect of the bias electric field and respectively approach to the electrodes having polarities opposite to themselves, the positive ions approach to the electrode on which a negative direct current voltage is applied, and the negative ions approach to the electrode on which a positive direct current voltage is applied. Detectors are respectively disposed outside different electrodes on the same axial direction. After the positive ions and negative ions are separated under the effect of the bias electric field, an excitation alternating current voltage AC is applied on the different electrodes on the same axial direction, then the positive ions are emitted from a negative electrode tip and detected, and the negative ions are emitted from an opposite direction and detected, thus separation and detection of the bipolar ions are realized. For example, the excitation alternating current voltage is applied to different electrodes on the same direction of x axis of the ion trap by an excitation alternating current voltage source to form an excitation alternating current electric field, the separated positive ions and negative ions are respectively emitted from the different electrodes of the ion trap under the effect of the excitation alternating current electric field and leave the ion trap. The positive ions are emitted from the electrode on which a negative direct current voltage is applied, and the negative ions are emitted from the electrode on which a positive direct current voltage is applied. For example, a first detector for detecting positive ions is disposed outside the electrodes of the ion trap for emitting the positive ions; and a second detector for detecting negative ions is disposed outside the electrodes of the ion trap for emitting the negative ions.

In order to emit the ions, openings are disposed on two different electrodes on the same axial direction of the ion trap on which the direct current voltage is applied, the ions being emitted from the openings on the electrodes.

(2) Quadrupole Field Direct Current Voltage Detection Mode

The motion track of ions in an ion trap is identical in pattern to a Mathieu equation, thus may be theoretically derived by solving the Mathieu equation, and satisfies the following second order differential equation;

$$\frac{d^2u}{d\xi^2} + (a_u - 2q_u\cos 2\xi)u = 0 \quad (1)$$

where u is motion track of the ions in the ion trap, u refers to x, y and z, $\xi$ is a parameter ($\xi=\Omega t/2$) related to a radian frequency $\Omega$ of a radio frequency voltage, t is time, and parameters $a_u$ and $q_u$ are respectively:

$$a_u = \frac{-8eU}{mr_0^2\Omega^2} \quad (2)$$

$$q_u = \frac{4eV}{mr_0^2\Omega^2} \quad (3)$$

where e is electric charge of the ion, m is mass of the ion, r0 is radius of the ion trap, $\Omega$ is the radian frequency of the radio frequency voltage, V is amplitude of the radio frequency voltage, and U is amplitude of the direct current voltage.

Figure 4:
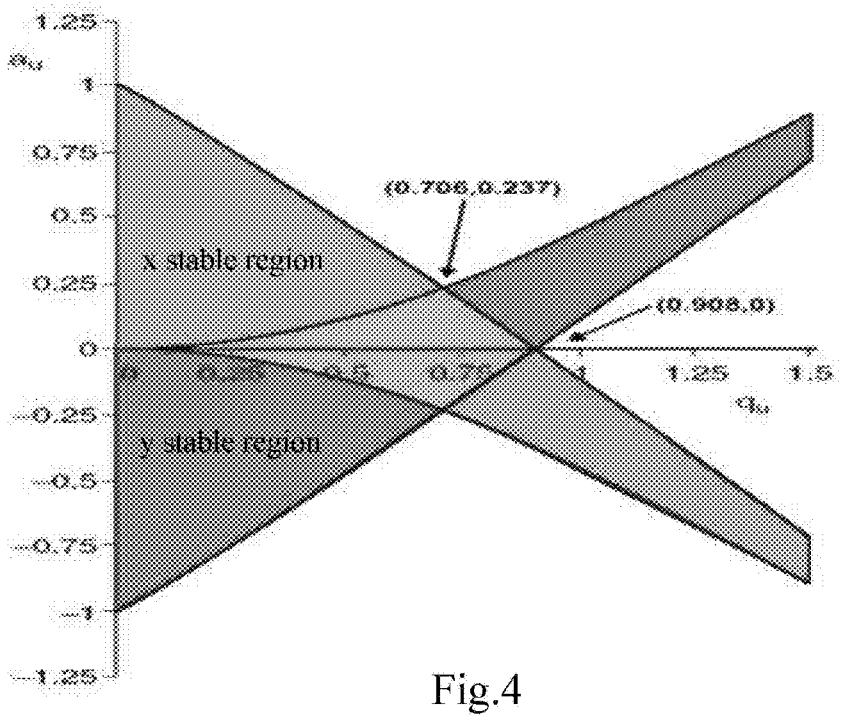
FIG. 4 illustrates a diagram showing stability of an ion trap according to an exemplary embodiment of the present disclosure.

It can be known from theoretical calculation that, when the parameters $a_u$ and $q_u$ satisfy a certain condition, the ion moves at a certain amplitude in the ion trap and is in a stable state. The $q_u$ is taken as an X-coordinate and the $a_u$ is taken as a Y-coordinate to conduct mapping, and regions satisfying stable conditions are called as stable regions. The region enabling the ion to be stable on the x direction is an x stable region, the region enabling the ion to be stable on the y direction is a y stable region, and the intersection of the x stable region and the y stable region is xy stable region, as shown in FIG. 4.

Figure 5:
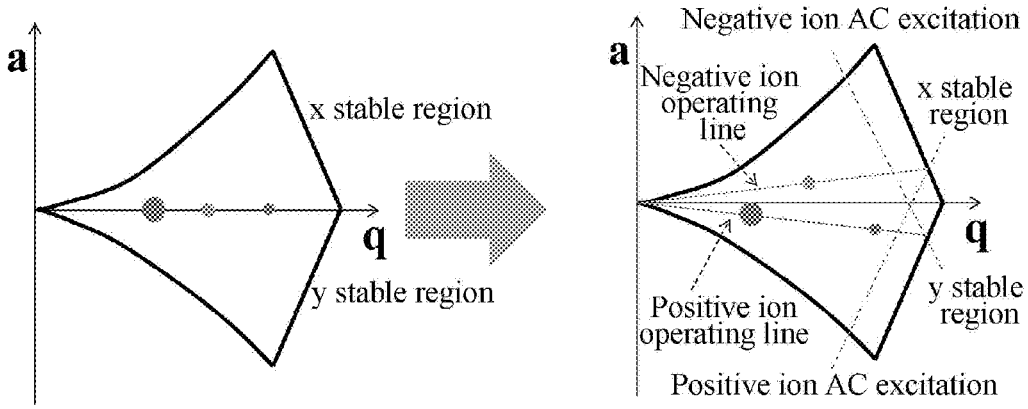
FIG. 5 illustrates a schematic diagram showing principles of a quadrupole field direct current voltage detection mode according to an exemplary embodiment of the present disclosure.

FIG. 5 is a block diagram showing principles of a quadrupole field direct current voltage detection mode according to exemplary embodiments of the present disclosure. In FIG. 5, the region encircled by four boundaries is an xy stable region, and ions stably stored in an ion trap are in the xy stable region; $a_u$ and $q_u$ values can be varied by changing V and U, so that the ions are in different stable states.

In case of not applying a direct current voltage on electrodes of the ion trap, the amplitude U of a direct current voltage is 0; it can be known from formula (2) that $a_u$=0, and positive ions and negative ions are on an X-coordinate $q_u$ as shown in the left portion in FIG. 5.

In case of applying a direct current voltage on the electrodes of the ion trap, $a_u$ is not equal to 0. When U and V are given, the positive ions and the negative ions are respectively arranged along a positive ion operating line and a negative ion operating line according to different mass-to-charge ratios thereof (therefore, the $a_u$ and $q_u$ values thereof are different). For example, if the voltage values of U and V are increased while keeping the UN unchanged (namely scanning the voltage along the operating line), the $a_u$ and $q_u$ values are increased; as shown in the right portion in FIG. 5, the positive ions travel along the positive ion operating line and the negative ions travel along the negative ion operating line; when the $a_u$ and $q_u$ values of the ions leave the xy stable region, the motion amplitudes of the ions on one direction are continuously increased so that the ions are ejected out of the ion trap.

Alternatively, the voltage values of U and V may also be increased while keeping the UN changed (namely scanning the voltage along the operating line); as a result, the $a_u$ and $q_u$ values are increased; the positive ions travel along the positive ion operating line and the negative ions travel along the negative ion operating line; when the $a_u$ and $q_u$ values of the ions exceed the xy stable region, the motion amplitudes of the ions on one direction are continuously increased so that the ions are ejected out of the ion trap.

For example, an excitation alternating current voltage AC may be applied on the electrodes of the ion trap by an excitation alternating current voltage source to form an excitation alternating current electric field; after the excitation alternating current voltage AC is applied, when the positive ions travel along the positive ion operating line and reach a positive ion AC excitation line, the positive ions are resonated and ejected out of the ion trap; when the negative ions travel along the negative ion operating line and reach a negative ion AC excitation line, the negative ions are resonated and ejected out of the ion trap.

Ions stably stored in the ion trap are in the xy stable region, and bipolar ions may be scanned along different operating lines by changing V and U. For example, the negative ions scanned along the negative ion operating line enter an x unstable region, causing the amplitude of the negative ions on the x direction increased, so that the negative ions tend to be emitted from the x direction; while the positive ions are scanned along the positive ion operating line, enter a y unstable region, and tend to be emitted from the y direction. The positive ions and the negative ions are respectively emitted from the y direction and the x direction through the radio frequency voltage and/or excitation alternating current voltage AC, thus separating and detecting the bipolar ions.

Figure 6B:
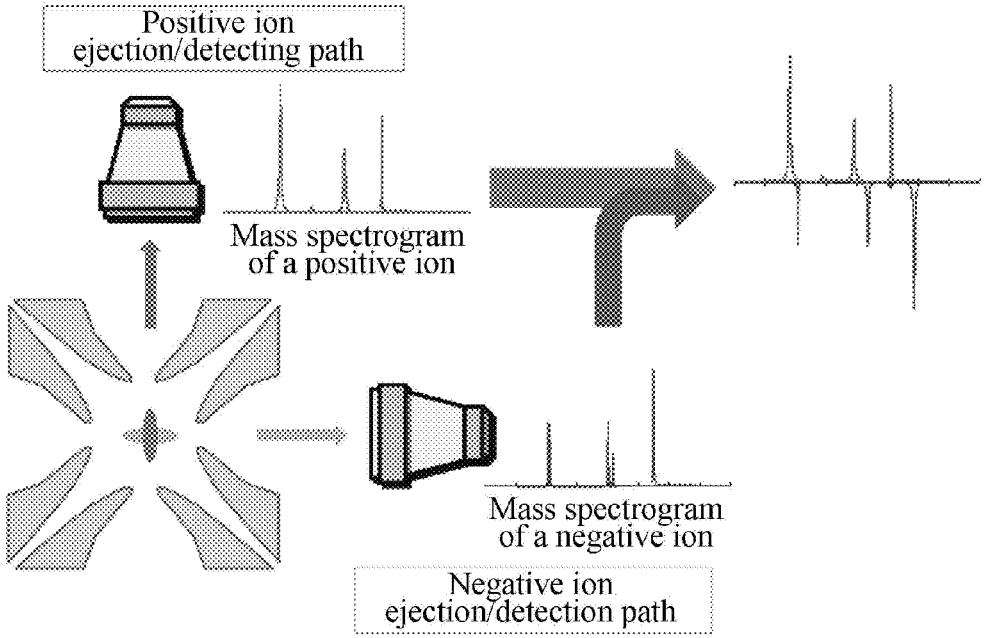

FIG. 6*a* and FIG. 6*b* illustrate schematic diagrams showing a quadrupole field direct current voltage detection mode according to exemplary embodiments of the present disclosure. As shown in FIG. 6*a* and FIG. 6*b*, an equal negative direct current voltage is applied on two electrodes on the y axis of an ion trap and an equal positive direct current voltage is applied on two electrodes on the x axis of the ion trap to form a bias electric field, the amplitudes of the negative direct current voltage and the positive direct current voltage may be equal or unequal to each other. Bipolar ions are separated under the effect of the bias electric field, so that positive ions are compressed on the x axis and negative ions are compressed on the y axis. For example, a manner of constant UV values is employed for scanning, the voltage values of U and V are increased while keeping the UV unchanged; as a result, the $a_u$ and $q_u$ values are increased, the compressed degrees of the bipolar ions are increased on their respective directions, and the bipolar ions tend to be emitted from different axial directions thereof. Detectors are respectively disposed on the x axis and y axis, and an excitation alternating current voltage AC is applied; then the positive ions are emitted from the y axis and detected, and the negative ions are emitted from the x axis and detected; thus, the bipolar ions are separated and detected, as shown in FIG. 6*b*.

For example, an equal negative direct current voltage is applied to two electrodes on the y axis of the ion trap and an equal positive direct current voltage is applied on two electrodes on the x axis by a direct current voltage source to form a bias electric field, the positive ions and the negative ions are separated under the effect of the bias electric field, so that the positive ions are compressed on the x axis and the negative ions are compressed on the y axis. As shown in FIG. 6*a*, ion clouds start to be homogeneously distributed; after a direct current voltage is applied, a positive ion cloud tends to be distributed on the y axis and a negative ion cloud tends to be distributed on the x axis. Detectors are disposed on the x axis and on the y axis; then the positive ions are emitted from the y axis and detected, and the negative ions are emitted from the x axis and detected.

For example, an excitation alternating current voltage may be applied on the two different electrodes on the x axis and on two different electrodes on the y axis by an excitation alternating current voltage source to form an excitation alternating current electric field; after the excitation alternating current electric field is formed, when the positive ions travel along a positive ion operating line and reach a positive ion AC excitation line, the positive ions are resonated and ejected out of the ion trap; after the negative ions travel along a negative ion operating line and reach a negative ion AC excitation line, the negative ions are resonated and ejected out of the ion trap, wherein the AC represents the excitation alternating current voltage.

To enable the ions to be emitted, openings are disposed on two electrodes on the y axis and two electrodes on the x axis of the ion trap, the ions are emitted from the openings.

Under a quadrupole field direct current voltage detection mode, selective MS/MS operations may also be performed. According to the ion trap theory, the motion frequencies of the ions on the x and y directions are controllable by regulating the amplitude of the radio frequency voltage, the frequency of the radio frequency voltage, the direct current voltage and the size of the ion trap. Based on this, a SWIFT excitation signal may be utilized to select ions having any polarity and any mass-to-charge ratio as parent ions for performing MS/MS and MS(n), and is especially applicable to respective detection of ions having the same mass-to-charge ratio but different polarities (as shown in FIGS. 7*a* to 7*f*). A quadrupole direct current electric field may firstly control the motion frequencies of one ion on the x direction and y direction to make the frequency values thereof unequal or equal, and may secondly control the motion frequencies of ions having different polarities on the x direction and y direction to make the frequency values thereof unequal or equal. In this way, ions having same mass-to-charge ratio but different charge polarities may achieve different or same motion frequencies on the x direction and/or y direction; when the ions have different motion frequencies, selective separation and analysis of the ions can be achieved. For example, the implementation manner thereof is as follows:

On the basis of mass spectrometry (also referred to as "MS" herein), a SWIFT excitation alternating current signal AC is firstly applied on the x axis, so that the selected ion is in a stable region and other ions are excited and ejected out of the ion trap; and then a SWIFT excitation alternating current signal is applied on the y axis, the selected ion is further determined, and interfering ions are eliminated. MS/MS scanning is performed on the parent ions obtained through the selection process, so that a mass spectrogram of ions having specific mass-to-charge ratio and polarity may be Obtained.

The example of the selective MS(n) analysis under a quadrupole field direct current voltage detection mode is described hereinafter with reference to FIGS. 7*a* to 7*f*.

Figure 7B:
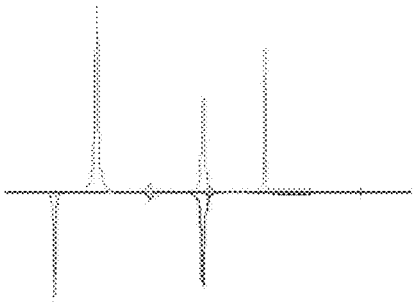
FIG. 7*a* to FIG. 7*f* illustrate schematic diagrams showing tandem mass spectrometry selectivity operation under the quadrupole field direct current voltage detection mode.
Figure 7A:
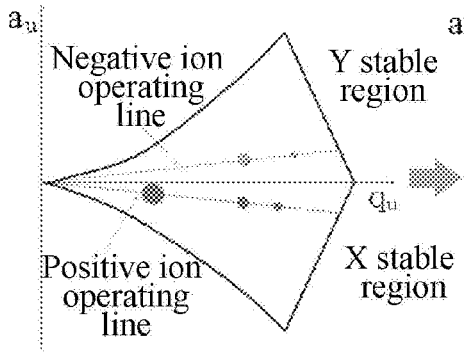

As shown in FIG. 7*a*, when the UN ratio is fixed, positive and negative ions are respectively arranged on two straight lines according to different mass-to-charge ratios thereof ($a_u$ and $q_u$ values are different); as an example, it is shown in the figures that there are five ions in XY stable region, including three positive ions (below $q_u$ axis) and two negative ions (above $q_u$ axis), but the present disclosure is not limited to five ions. MS analysis and detection may be performed on the ions in the xy stable region as shown in FIG. 7*a* by employing, for example, any ion trap-based device and method for analyzing and detecting bipolar ions of the present disclosure or any method of related art. FIG. 7*b* illustrates a mass spectrogram of MS analysis and detection. In FIG. 7*b*, a mass spectrogram of a positive ion is above the X-coordinate and a mass spectrogram of a negative ion is below the X-coordinate, wherein $a_u$ and $q_u$ are the Y-coordinate and X-coordinate in an ion trap stability diagram.

MS/MS and MS(n) analysis may be performed on the basis of the MS, as shown in FIG. 7*c* to FIG. 7*f*.

Firstly, (a) a radio frequency voltage is applied on electrodes of an ion trap to form a radio frequency electric field; negative direct current voltages with a same magnitude are applied on two electrodes on the y axis of the ion trap and positive direct current voltages with a same magnitude are applied on two electrodes on the x axis of the ion trap to form a bias electric field, positive ions and negative ions in the ion trap being separated under the effect of the bias electric field, so that the positive ions are compressed on the x axis and the negative ions are compressed on the y axis, and the amplitudes of the negative direct current voltages and the positive direct current voltages being equal or unequal.

Figure 7C:
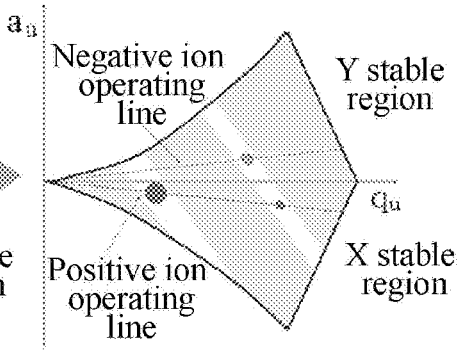

Then, (b) a SWIFT excitation signal is applied on the x direction of the electrode of the ion trap, then ions in an excitation signal region (dark color region) are unsteadily emitted from the ion trap, and ions in a non-excitation signal region (white region) are stably stored in the ion trap, thus enabling selection of ions having a specific mass number at a time, as shown in FIG. 7*c*.

Next, (c) a SWIFT excitation signal is applied on the y direction of the electrode of the ion trap, then ions in an excitation signal region are unsteadily emitted from the ion trap, and ions in a non-excitation signal region are stably stored in the ion trap, as shown in FIG. 7*c*.

Figure 7E:
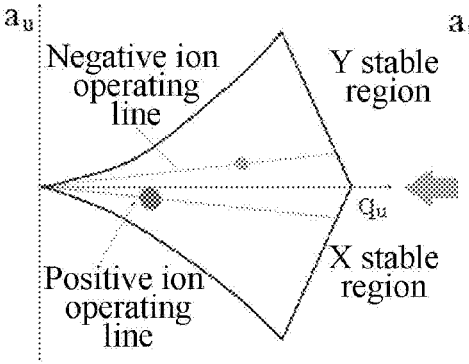
Figure 7D:
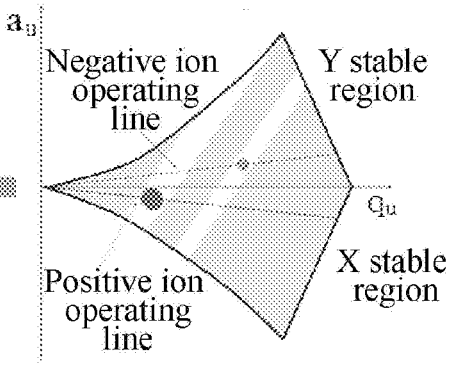

Integrating the two steps mentioned above, the ions in the two non-excitation regions (overlapped portion of the two white regions) of x and y are stably stored, thus enabling selection of specific ions, as shown in FIG. 7*d*.

Figure 7F:
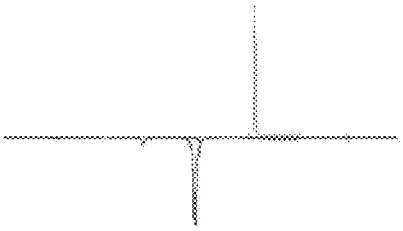

Then, (d) the voltage values of U and V are increased while keeping the UN unchanged (scanning the voltage along an operating line); as a result, the $a_u$ and $q_u$ values are increased; as shown in the figure, positive and negative ions respectively travel along a positive ion operating line and a negative ion operating line; when the $a_u$ and $q_u$ values of the ions exceed the xy stable region, the motion amplitudes of the ions on one direction are continuously increased so that the ions are ejected out of the ion trap, thus enabling detection of selected specific ions, as shown in FIG. 7*e*. FIG. 7*f* shows a mass spectrogram corresponding to FIG. 7*e*.

As an alternative solution, the foregoing steps (b) and (c) may be performed simultaneously.

Figure 8A:
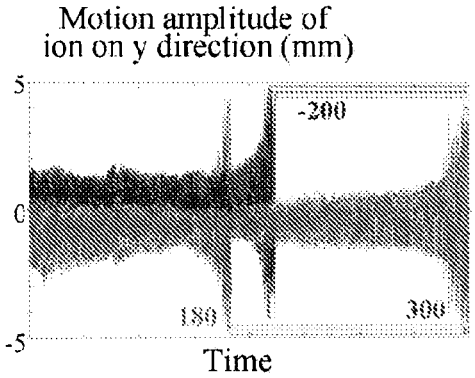
FIG. 8*a* and FIG. 8*b* respectively illustrate emitting track and mass spectrogram of simulation ions in the exemplary embodiment of the bipole field direct current voltage detection mode.
Figure 8B:
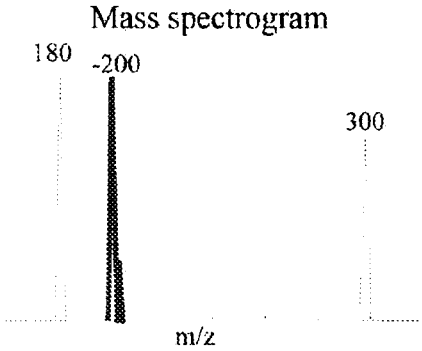
Figure 9A:
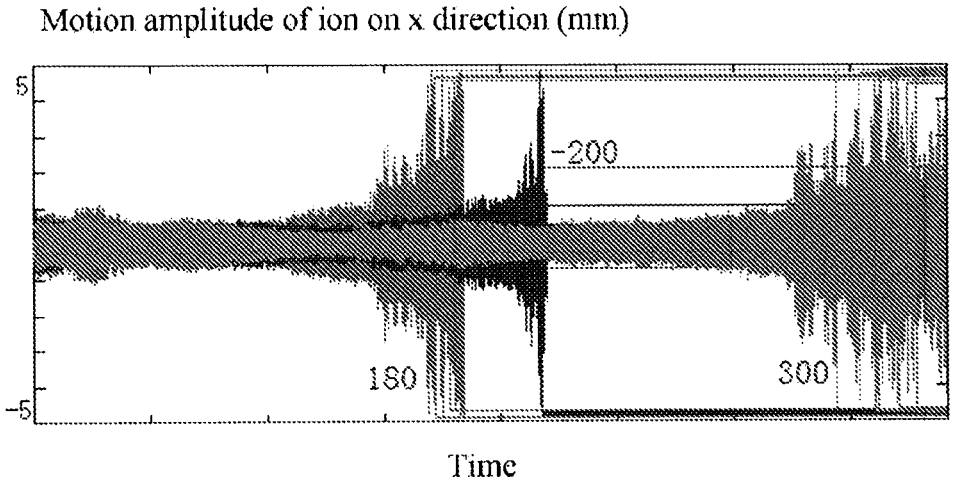
FIG. 9*a* and FIG. 9*b* respectively illustrate emitting tracks of simulation ions on the X axis and Y axis in the exemplary embodiment of the quadrupole field direct current voltage detection mode.
Figure 9B:
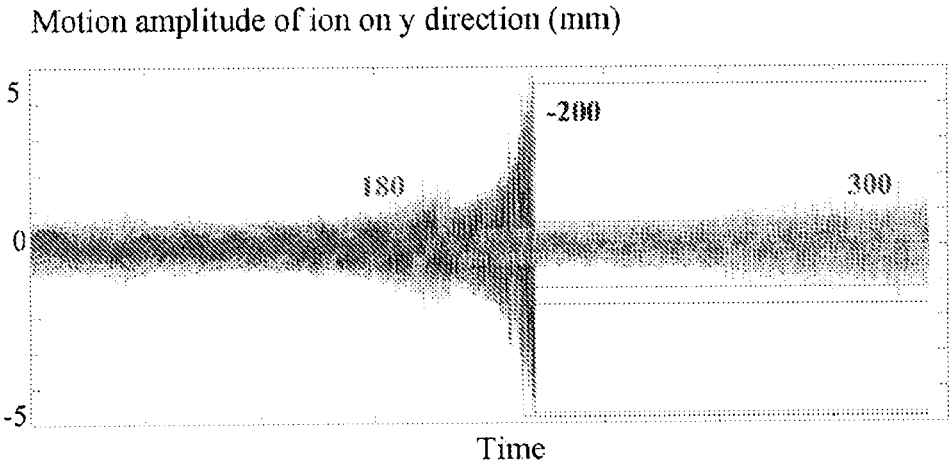

To sufficiently illustrate the characteristics of the present disclosure and manners of implementing the present disclosure, embodiments are given hereinafter. FIG. 8*a* and FIG. 8*b* respectively illustrate emitting track and mass spectrogram of simulation ions in the exemplary embodiments under a bipole field direct current voltage detection mode. FIG. 9*a* and FIG. 9*b* respectively illustrate emitting tracks of simulation ions on the X axis and Y axis in exemplary embodiments under a quadrupole field direct current voltage detection mode.

In the following embodiments, Matlab™ is used to write programs and conduct ion track simulation tests. The motion track of an ion having a mass-to-charge ratio of 180, the motion track of an ion having a mass-to-charge ratio of −200 and the motion track of an ion having a mass-to-charge ratio of 300 are respectively shown.

(1) Embodiment of the Bipole Field Direct Current Voltage Detection Mode:

Simulation test parameters: three types of ion having the mass-to-charge ratios of 180, −200 and 300 are selected; an initial radio frequency voltage has a voltage of 380 V and a frequency of 1,000,000 Hz; an initial direct current voltage has a voltage of 5 V; a scanning speed is 1,000 V/s; and an excitation alternating current voltage has a voltage of 20 V and a frequency of 300,000 Hz.

Simulation test results: as shown in FIG. 8, the ions having the mass-to-charge ratios of 180 and 300 are emitted from the direction of negative y axis, while the ions having the mass-to-charge ratio of −200 are emitted from the direction of positive y axis, and the emitting efficiency of the both directions is 100%.

(2) Embodiment of a Quadrupole Field Direct Current Voltage Detection Mode:

Simulation test parameters: three types of ion having the mass-to-charge ratios of 180, −200 and 300 are selected; an initial radio frequency voltage has a voltage of 380 V and a frequency of 1,000,000 Hz, and a scanning speed is 1,000 V/S; an initial direct current voltage has a voltage of 28.5 V (380*0.075), a scanning speed is 1,000 V/s, and a UN value is 0.075; and an excitation alternating current voltage has a voltage of 20 V and a frequency of 310,000 Hz.

Simulation test results: as shown in FIG. 9, the ions having the mass-to-charge ratios of 180 and 300 are emitted from the direction of x axis, while the ions having the mass-to-charge ratio of −200 are emitted from the direction of y axis, and the emitting efficiency of the positive ions is higher.

The above descriptions about the embodiments of the present invention are explanatory only for the technical solution of the present invention, and not restrictive of the scope of the present invention. The present invention is not limited to these disclosed embodiments. Those skilled in the art may make modifications on the technical solutions recorded in each forgoing embodiment, or make equivalent substitutions on partial technical characteristics therein, while these modifications or substitutions shall all fall within the protection scope of the present invention.

REFERENCES

[1] Guangming Huang, Guangtao Li, and R. Graham Cooks. Induced Nanoelectrospray Ionization for Matrix-Tolerant and High-Throughput Mass Spectrometry. Angew. Chem., 2011, 50: 9907-9910

[2] Guangming Huang, Guangtao Li, Jason Ducan, Zheng Ouyang, and R. Graham Cooks. Synchronized Inductive Desorption Electrospray Ionization Mass Spectrometry. Angew. Chem. 2011, 50: 2503-2506

[3] Nishant Chetwani, Catherine A. Cassou, David B. Go, and Hsueh-Chi Chang. High-Frequency AC Electrospray Ionization Source for Mass Spectrometry of Biomolecules. Am Soc Mass Spectrom, 2010, 21: 1852-1856

[4] Nishant Chetwani, Catherine A. Cassou, David B. Go, and Hsueh-Chi Chang. Frequency Dependence of Alternating Current Electrospray Ionization Mass Spectrometry.

[5] Han-Kwang Chen, Chia-Kai Chang, Chih-Che Wu, Ming-Chia Huang, and Yi-Sheng Wang. Synchronized Dual-Polarity Electrospray Ionization Mass Spectrometry. Am Soc Mass Spectrom 2009, 20: 2254-2257

[6] Shang-Ting Tsai, Chiu Wen Chen, Ling Chu Lora Huang, Min-Chia Huang, Chung-Hsuan Chen, and Yi-Sheng Wang. Simultaneous Mass Analysis of Positive and Negative Ions Using a Dual-Polarity Time-of-Flight Mass Spectrometer. Anal. Chem. 2006, 78: 7729-7734

We claim:

1. An ion trap-based device for analyzing and detecting bipolar ions, comprising:

an ion trap, the ion trap comprising multiple electrodes;

a radio frequency voltage source (RF), configured to apply a radio frequency voltage (V) on the electrodes of the ion trap to form a radio frequency electric field;

a direct current voltage source, configured to apply a direct current voltage (U) on different electrodes of the ion trap to form a bias electric field, positive ions and negative ions in the ion trap being separated under the effect of the bias electric field;

a first detector, disposed outside electrodes of the ion trap for emitting the positive ions and configured to detect the positive ions; and a second detector, disposed outside electrodes of the ion trap for emitting the negative ion and configured to detect the negative ions.

2. The device for analyzing and detecting bipolar ions according to claim 1, wherein:

the different electrodes of the ion trap are two different electrodes on a same axis of the ion trap, and the applying the direct current voltage on the different electrodes of the ion trap to form the bias electric field is to respectively apply a positive direct current voltage and a negative direct current voltage having equal or unequal values but opposite polarities on the two different electrodes on the same axis of the ion trap to form the bias electric field, the positive ions and the negative ions in the ion trap being separated under the effect of the bias electric field and respectively approaching to an electrode having polarity opposite to themselves, the positive ions approaching to an electrode on which the negative direct current voltage is applied, and the negative ions approaching to an electrode on which the positive direct current voltage is applied, wherein the device for analyzing and detecting bipolar ions further comprises an excitation alternating current voltage source, the excitation alternating current voltage source applies an excitation alternating current voltage on the two different electrodes on the same axis to form an excitation alternating current electric field after the positive ions and the negative ions are separated under the effect of the bias electric field, the separated positive ions and negative ions being respectively emitted from the different electrodes of the ion trap under the effect of the excitation alternating current electric field and leaving the ion trap, and there are openings, from which the ions are emitted, disposed on the two different electrodes on the same axis of the ion trap; and the positive ions being emitted from an electrode tip on which the negative direct current voltage is applied and being detected by the first detector, and the negative ions being emitted from an electrode tip on which the positive direct current voltage is applied and being detected by the second detector.

3. The device for analyzing and detecting bipolar ions according to claim 2, wherein an initial value of the positive direct current voltage is 5 V, an initial value of the negative direct current voltage is −5 V, and a scanning speed of the positive direct current voltage and the negative direct current voltage is 1,000 V/s; an amplitude of the excitation alternating current voltage is 20 V, and a frequency of the excitation alternating current voltage is 300,000 Hz; an initial voltage amplitude of the radio frequency voltage is 380 V, a frequency of the radio frequency voltage is 1,000,000 Hz, and a scanning speed of the radio frequency voltage is 1,000 V/s.

4. The device for analyzing and detecting bipolar ions according to claim 1, wherein the different electrodes of the ion trap comprise two electrodes on a direction of y axis of the ion trap and two electrodes on a direction of x axis of the ion trap, and the applying the direct current voltage on the different electrodes of the ion trap to form the bias electric field is to apply negative direct current voltages having an equal value on the two electrodes on the direction of y axis of the ion trap and apply positive direct current voltages having an equal value on the two electrodes on the direction of x axis of the ion trap, the bias electric field being formed by the negative direct current voltages and the positive direct current voltages, the amplitudes of the negative direct current voltages and the positive direct current voltages being equal or unequal to each other, and the positive ions and the negative ions in the ion trap being separated under the effect of the bias electric field, so that the positive ions are compressed on the direction of x axis and the negative ions are compressed on the direction of y axis; and a manner of scanning with the direct current voltage and a manner of scanning with the radio frequency voltage are employed to increase the amplitude of the direct current voltage and increase the amplitude of radio frequency voltage, the compression degree of the positive ions on the direction of x axis is increased, and the compression degree of the negative ions on the direction of y axis is increased, the positive ions tend to be emitted from the direction of y axis and the negative ions tend to be emitted from the direction of x axis; and when the ions leave a xy stable region, the motion amplitudes of the ions on one direction are continuously increased until to be ejected out of the ion trap, the positive ions being ejected from the direction of y axis and the negative ions being ejected from the direction of x axis.

5. The device for analyzing and detecting bipolar ions according to claim 4, wherein the amplitudes of the negative direct current voltage and the positive direct current voltage are equal to each other, the amplitudes of the negative direct current voltage and the positive direct current voltage are U, and the amplitude of the radio frequency voltage is V; when U and V are given, the positive ions and the negative ions are respectively arranged along a positive ion operating line and a negative ion operating line according to different mass-to-charge ratios thereof; the voltage values of U and V are increased while keeping a UN value unchanged, the positive ions travel along the positive ion operating line and the negative ions travel along the negative ions operating line; when the ions leave the xy stable region, the motion amplitudes of the ions on one direction are continuously increased until to be ejected out of the ion trap.

6. The device for analyzing and detecting bipolar ions according to claim 5, wherein the device for analyzing and detecting bipolar ions further comprises an excitation alternating current voltage source, the excitation alternating current voltage source applies an excitation alternating current voltage on two different electrodes on the direction of x axis and two different electrodes on the direction of y axis to form an excitation alternating current electric field; after the excitation alternating current electric field is formed, when the positive ions travel along the positive ions operating line and reach a positive ion AC excitation line, the positive ions are resonated and ejected out of the ion trap, and when the negative ions travel along the negative ions operating line and reach a negative ion AC excitation line, the negative ions are resonated and ejected out of the ion trap, wherein the AC represents the excitation alternating current voltage.

7. The device for analyzing and detecting bipolar ions according to claim 6, wherein an initial voltage amplitude of the radio frequency voltage is 380 V, a frequency of the radio frequency voltage is 1,000,000 Hz, and a scanning speed of the radio frequency voltage is 1,000 V/s; the UN value is 0.075; an amplitude of the excitation alternating current voltage is 20 V, and a frequency of the excitation alternating current voltage is 310,000 Hz.

8. A multi-stage tandem mass spectrometry device for bipolar ions, comprising:

a radio frequency voltage source, configured to apply an initial radio frequency voltage on electrodes of an ion trap to form a radio frequency electric field;

a direct current voltage source, configured to apply a direct current voltage on different electrodes of the ion trap to form a bias electric field, the different electrodes of the ion trap comprising two electrodes on a direction of y axis of the ion trap and two electrodes on a direction of x axis of the ion trap, the applying the direct current voltage on the different electrodes of the ion trap to form the bias electric field comprising applying negative direct current voltage having an equal value on the two electrodes on the direction of y axis of the ion trap and apply positive direct current voltage having an equal value on the two electrodes on the direction of x axis of the ion trap, the bias electric field being formed by the negative direct current voltage and the positive direct current voltage; the amplitudes of the negative direct current voltage and the positive direct current voltage being equal or unequal to each other, and the positive ions and the negative ions in the ion trap being separated under the effect of the bias electric field, so that the positive ions are compressed on the direction of x axis and the negative ions are compressed on the direction of y axis; and an excitation signal source, configured to, after the positive ions and the negative ions are separated under the effect of the bias electric field, firstly, apply a SWIFT excitation alternating current signal on the electrode on the direction of x axis of the ion trap, so as to make selected ions be kept in a stable region and other ions be excited and ejected out of the ion trap; and then apply a SWIFT excitation alternating current signal on the electrode on the direction of y axis of the ion trap and further determine the selected ions from the ions stably stored in the ion trap, so as to make the selected ions be kept in the stable region and other ions be excited and ejected out of the ion trap; and the ion trap-based device for analyzing and detecting bipolar ions according to claim 1, the ion trap-based device for analyzing and detecting bipolar ions being configured to analyze and detect bipolar ions in the selected ions that are stored in the ion trap.

9. A multi-stage tandem mass spectrometry device for bipolar ions, comprising:

a radio frequency voltage source, configured to apply an initial radio frequency voltage on electrodes of an ion trap to form a radio frequency electric field;

a direct current voltage source, configured to apply a direct current voltage on different electrodes of the ion trap to form a bias electric field, the different electrodes of the ion trap comprising two electrodes on a direction of y axis of the ion trap and two electrodes on a direction of x axis of the ion trap, the applying the direct current voltage on the different electrodes of the ion trap to form the bias electric field comprising applying negative direct current voltage having an equal value on the two electrodes on the direction of y axis of the ion trap and apply positive direct current voltage having an equal value on the two electrodes on the direction of x axis of the ion trap, the bias electric field being formed by the negative direct current voltage and the positive direct current voltage; the amplitudes of the negative direct current voltage and the positive direct current voltage being equal or unequal to each other, and the positive ions and the negative ions in the ion trap being separated under the effect of the bias electric field, so that the positive ions are compressed on the direction of x axis and the negative ions are compressed on the direction of y axis; and an excitation signal source, configured to, after the positive ions and the negative ions are separated under the effect of the bias electric field, simultaneously applying a SWIFT excitation alternating current signal on the electrode on the direction of x axis of the ion trap and applying a SWIFT excitation alternating current signal on the electrode on the direction of y axis of the ion trap, so as to make selected ions be kept in a stable region and other ions be excited and ejected out of the ion trap; and the ion trap-based device for analyzing and detecting bipolar ions according to claim 1, the ion trap-based device for analyzing and detecting bipolar ions being configured to analyze and detect bipolar ions in the selected ions that are stored in the ion trap.

10. An ion trap-based method for analyzing and detecting bipolar ions, comprising:

applying a radio frequency voltage on electrodes of an ion trap to form a radio frequency electric field;

applying a direct current voltage on different electrodes of the ion trap to form a bias electric field, positive ions and negative ions in the ion trap being separated under the effect of the bias electric field; and the positive ions being emitted from an electrode tip on which a negative direct current voltage is applied and being detected, and the negative ions being emitted from an electrode tip on which a positive direct current voltage is applied and being detected.

11. The method according to claim 10, wherein:

the different electrodes of the ion trap are two different electrodes on a same axis of the ion trap, and the applying the direct current voltage on the different electrodes of the ion trap to form the bias electric field comprises respectively applying a positive direct current voltage and a negative direct current voltage having equal or unequal values but opposite polarities on the two different electrodes on the same axis of the ion trap to form the bias electric field, the positive ions and the negative ions in the ion trap being separated under the effect of the bias electric field and respectively approaching to an electrodes having polarity opposite to themselves, the positive ions approaching to an electrode on which the negative direct current voltage is applied, and the negative ions approaching to an electrode on which the positive direct current voltage is applied, wherein applying an excitation alternating current voltage on the two different electrodes on the same axis to form an excitation alternating current electric field, the separated positive ions and negative ions being respectively emitted from the different electrodes of the ion trap under the effect of the excitation alternating current electric field and leaving the ion trap, and there are openings, from which the ions are emitted, being disposed on the two different electrodes on the same axis of the ion trap; and the positive ions being emitted from an electrode tip on which the negative direct current voltage is applied and being detected, and the negative ions being emitted from an electrode tip on which the positive direct current voltage is applied and being detected.

12. The method according to claim 11, wherein an initial value of the positive direct current voltage is 5 V, an initial value of the negative direct current voltage is −5 V, and a scanning speed of the positive direct current voltage and the negative direct current voltage is 1,000 Ws; an amplitude of the excitation alternating current voltage is 20 V, and a frequency of the excitation alternating current voltage is 300,000 Hz; an initial voltage amplitude of the radio frequency voltage is 380 V, a frequency of the radio frequency voltage is 1,000,000 Hz, and a scanning speed of the radio frequency voltage is 1,000 V/s.

13. The method according to claim 10, wherein the different electrodes of the ion trap comprise two electrodes on a direction of y axis of the ion trap and two electrodes on a direction of x axis of the ion trap, and the applying the direct current voltage on the different electrodes of the ion trap to form the bias electric field is to apply negative direct current voltages having an equal value on the two electrodes on the direction of y axis of the ion trap and apply equal positive direct current voltages having an equal value on the two electrodes on the direction of x axis of the ion trap, the bias electric field being formed by the negative direct current voltages and the positive direct current voltages, the amplitudes of the negative direct current voltages and the positive direct current voltages being equal or unequal to each other, and the positive ions and the negative ions in the ion trap being separated under the effect of the bias electric field, so that the positive ions are compressed on the direction of x axis and the negative ions are compressed on the direction of y axis; and a manner of scanning with the direct current voltage and a manner of scanning with the radio frequency voltage system mode are employed to increase the amplitude of the direct current voltage and increase the amplitude of radio frequency voltage, the compression degree of the positive ions on the direction of x axis is increased, and the compression degree of the negative ions on the direction of y axis is increased, the positive ions tend to be emitted from the direction of y axis and the negative ions tend to be emitted from the direction of x axis; and when the ions leave a xy stable region, the motion amplitudes of the ions on one direction are continuously increased until to be ejected out of the ion trap, the positive ions being ejected from the direction of y axis and the negative ions being ejected from the direction of x axis.

14. The method according to claim 13, wherein the amplitudes of the negative direct current voltage and the positive direct current voltage are equal to each other, the amplitudes of the negative direct current voltage and the positive direct current voltage are U, and the amplitude of the radio frequency voltage is V; when U and V are given, the positive ions and the negative ions are respectively arranged along a positive ions operating line and a negative ions operating line according to different mass-to-charge ratios thereof; the voltage values of U and V are increased while keeping a U/V value unchanged, the positive ions travel along the positive ions operating line and the negative ions travel along the negative ions operating line; when the ions leave the xy stable region, the motion amplitudes of the ions on one direction are continuously increased until to be ejected out of the ion trap.

15. The method according to claim 14, wherein applying an excitation alternating current voltage on two different electrodes on the direction of x axis and two different electrodes on the direction of y axis to form an excitation alternating current electric field; after the excitation alternating current electric field is formed, when the positive ions travel along the positive ions operating line and reach a positive ions AC excitation line, the positive ions are resonated and ejected out of the ion trap; when the negative ions travel along the negative ions operating line and reach a negative ions AC excitation line, the negative ions are resonated and ejected out of the ion trap, wherein the AC represents the excitation alternating current voltage.

16. The method according to claim 15, wherein an initial voltage amplitude of the radio frequency voltage is 380 V, a frequency of the radio frequency voltage is 1,000,000 Hz, and a scanning speed of the radio frequency voltage is 1,000 V/s; the U/V value is 0.075; an amplitude of the excitation alternating current voltage is 20 V, and a frequency of the excitation alternating current voltage is 310,000 Hz.

17. A multistage tandem mass spectrometry method for bipolar ions, comprising:

firstly, applying an initial radio frequency voltage on electrodes of an ion trap to form a radio frequency electric field; applying a direct current voltage on different electrodes of the ion trap to form a bias electric field, the different electrodes of the ion trap comprising two electrodes on a direction of y axis of the ion trap and two electrodes on a direction of x axis of the ion trap, the applying the direct current voltage on the different electrodes of the ion trap to form the bias electric field comprising applying negative direct current voltage having an equal value on the two electrodes on the direction of y axis of the ion trap and applying positive direct current voltage having an equal value on the two electrodes on the direction of x axis of the ion trap, the bias electric field being formed by the negative direct current voltage and the positive direct current voltage, the amplitudes of the negative direct current voltage and the positive direct current voltage being equal or unequal to each other, and the positive ions and the negative ions in the ion trap being separated under the effect of the bias electric field, so that the positive ions are compressed on the direction of x axis and the negative ions are compressed on the direction of y axis;

then, applying a SWIFT excitation alternating current signal on the electrode on the direction of x axis of the ion trap, so as to make selected ions be kept in a stable region and other ions be excited and ejected out of the ion trap;

next, applying a SWIFT excitation alternating current signal on the electrode on the direction of y axis of the ion trap, and further determining the selected ions from the ions stably stored in the ion trap, so as to make the selected ions be kept in the stable region and other ions be excited and ejected out of the ion trap; and then, employing the method according to claim 10 to analyze and detect bipolar ions in the selected ions that are stored in the ion trap.

18. A multi-stage tandem mass spectrometry method for bipolar ions, comprising:

firstly, applying an initial radio frequency voltage on electrodes of an ion trap to form a radio frequency electric field; applying a direct current voltage on different electrodes of the ion trap to form a bias electric field, the different electrodes of the ion trap comprising two electrodes on a direction of y axis of the ion trap and two electrodes on a direction of x axis of the ion trap, the applying the direct current voltage on the different electrodes of the ion trap to form the bias electric field comprising applying negative direct current voltage having an equal value on the two electrodes on the direction of y axis of the ion trap and applying positive direct current voltage having an equal value on the two electrodes on the direction of x axis of the ion trap, the bias electric field being formed by the negative direct current voltage and the positive direct current voltage, the amplitudes of the negative direct current voltage and the positive direct current voltage being equal or unequal to each other, and the positive ions and the negative ions in the ion trap being separated under the effect of the bias electric field, so that the positive ions are compressed on the direction of x axis and the negative ions are compressed on the direction of y axis;

then, simultaneously applying a SWIFT excitation alternating current signal on the electrode on the direction of x axis of the ion trap and applying a SWIFT excitation alternating current signal on the electrode on the direction of y axis of the ion trap, so as to make selected ions be kept in a stable region and other ions be excited and ejected out of the ion trap;

next, employing the method according to any one of claims 10 to 16 to analyze and detect bipolar ions in the selected ions that are stored in the ion trap.

* * * * *